US005476391A

United States Patent [19]

Katsuma

[11] Patent Number: 5,476,391

[45] Date of Patent: Dec. 19, 1995

[54] LEVER TYPE CONNECTOR ASSEMBLY

[75] Inventor: Takatoshi Katsuma, Yokkaichi, Japan

[73] Assignee: Sumitomo Wiring Systems, Ltd., Japan

[21] Appl. No.: 255,374

[22] Filed: Jun. 8, 1994

[30] Foreign Application Priority Data

Jun. 15, 1993 [JP] Japan ..... 5-169628
Jun. 24, 1993 [JP] Japan ..... 5-179986

[51] Int. Cl.[6] ..... H01R 13/62

[52] U.S. Cl. ..... 439/157; 439/155

[58] Field of Search ..... 439/152–160, 439/372, 840, 73

[56] References Cited

U.S. PATENT DOCUMENTS

| | | | |
|---|---|---|---|
| 4,632,481 | 12/1986 | Magourou | 339/46 |
| 4,657,328 | 4/1987 | Matsuoka | 339/75 MP |
| 5,135,408 | 8/1992 | Suzuki | 439/157 |
| 5,174,785 | 12/1992 | Endo et al. | 439/157 |
| 5,178,553 | 1/1993 | Hatagishi et al. | 439/157 |

FOREIGN PATENT DOCUMENTS

| | | | |
|---|---|---|---|
| 1151580 | 7/1963 | Germany | H02F 21/22 |
| 2179506 | 3/1987 | United Kingdom . | |
| 2260659 | 4/1993 | United Kingdom | H01R 13/629 |

*Primary Examiner*—David L. Pirlot
*Attorney, Agent, or Firm*—Jordan B. Bierman; Bierman and Muserlian

[57] ABSTRACT

This invention simplifies a process of attaching a torsion coil spring (6) to an arm (22) of a lever (21). Each arm (22) of the lever (21) is provided on its inner face with a ring slot (25) formed around a bearing hole (23) for accommodating a ring portion (6*a*) of the torsion coil spring (6) and a pair of holding slots (26 ) and (27) communicated with the ring slot (25) for accommodating end portions (6*b*) and (6*c*). A raised guide (29) is formed on the inner face of the arm (22) near an outer edge of the holding slot (27). The raised guide (29) has a ramp face (30) which continuously increases in height approaching the holding slot (27) and a precipices (33) contiguous to the outer edge of the slot (27). The arm (22) of the lever (21) may be provided on its inner face with a circular are tool slot (32) having a certain depth and extending from an end face of the arm (22) across a cam groove to the holding slot (27).

3 Claims, 10 Drawing Sheets

LEVER TYPE CONNECTOR ASSEMBLY

BACKGROUND OF THE INVENTION

1. Field of the Invention

This invention relates to a lever type connector assembly which interconnects and separates connectors by utilizing a cam action and more particularly to a lever type connector assembly in which a torsion coil spring for rockably biasing a lever to a given initial position is temporarily attached to one of the connectors.

2. Statement of the Prior Art

A lever type connector assembly has an advantage of interconnecting and separating connectors by a small force and particularly can be applied to multipole connectors.

For convenience of explanation, a conventional lever type connector assembly will be explained below by referring to drawings.

FIG. 10 is an exploded perspective view of a conventional lever type connector assembly. FIG. 11 is a perspective view of a lever shown in FIG. 10, illustrating a torsion coil spring mounted on a side plate of the lever. FIG. 12 is a perspective view of a female connector housing shown in FIG. 10. FIG. 13 is a fragmentary cross sectional view of the housing and lever shown in FIG. 10, illustrating a position at which an end of the torsion coil spring engages with the housing. FIG. 14 is a perspective view of a conventional torsion coil spring. FIG. 15 is a fragmentary enlarged perspective view of the lever shown in FIG. 11. FIG. 16 is a cross sectional view of the lever shown in FIG. 11, illustrating a process of attaching the torsion coil spring to the lever. FIG. 17 is a longitudinal sectional view of the lever, illustrating a process of attaching an end of the torsion coil spring into a holding slot in the lever.

An example of a conventional connector housing assembly, as shown in FIG. 10, includes one (female) connector housing 1, a lever 3 mounted rotatably on a pair of support axles 4 on the housing 1 and having cam grooves 3*a*, and the other (male) connector housing 2 having a pair of cam followers 5. The pair of connector housings 1 and 2 are coupled to and detached from each other when the lever 3 is turned about the axles 4 to move the cam followers 5.

In the above lever type connector assembly, in order to bias the lever 3 to a given rotary direction, a torsion coil spring 6 shown in FIG. 14 is coupled to the lever 3 and female connector housing 1, as shown in FIGS. 11 to 13. At this time, a ring portion 6*a* of the spring 6 (FIG. 14) is disposed around a bearing hole 3*b* and on an inner face of a side plate or arm 22*a* of the lever (see FIG. 11), an end portion 6*b* of the spring 6 engages with the inner face of the arm 22*a* (see FIG. 11), and the other end portion 6*c* of the spring 6 engages with a projection la on an outer face of the connector housing 1 (see FIGS. 12 and 13).

Upon constructing the above lever type connector assembly, after fitting the ring portion 6*a* of the torsion coil spring 6 on the support axle 4 on the connector housing 1, one end portion 6*b* of the spring 6 is locked on a part of the lever 3 and the other end portion 6*c* of the spring 6 is locked on the projection la on the connector housing. This requires very difficult work and is inefficient.

In order to avoid such difficult constructing work, the present applicant has proposed a lever type connector assembly in which the lever is provided with a pair of holding slots which accommodate opposite end portions of the torsion coil spring with it being biased, and in which one end portion of the spring accommodated in one holding slot is transferred from the slot to the connector housing after mounting the lever on the housing (Japanese Utility Model Public Disclosure No. 6-11 70. According to this assembly, it is possible to greatly facilitate the work of mounting the lever on the connector housing, since the torsion coil spring is accommodated In the holding slots beforehand and the torsion coil spring on the lever does not interfere with the connector housing upon mounting the lever on the housing.

However, although the above assembly enhances a work of mounting the lever on the connector housing, the work of attaching the torsion coil spring to the lever had to be improved.

That is, in order to attach the torsion coil spring 6 shown in FIG. 14 to the side plate 22*a* of the lever 3, the side plate 22*a* is provided in the inner face with a pair of holding slots 7 and 8 which receive opposite end portions 6*b* and 6*c* of the torsion coil spring 6 with the spring 6 being biased, as shown in FIGS. 15 and 16. First, one end portion 6*b* of the spring 6 is inserted into one holding slot 7 and the other end portion 6*c* is pushed and turned by a tool pin similar to an end of a ball pen to insert the end portion 6*c* into the other holding slot 8. At this time, since the other end portion 6*c* of the torsion coil spring 6 applies an elastic force to the tool pin 9, the tool pin 9 must be moved carefully so that the portion 6*c* does not leap over the tool pin 9 on account of its elastic force. Then, as shown in FIG. 17, when the end portion 6*c* is moved near the other holding slot 8, a distal end of the tool pin 9 must apply a downward force in addition to a forward force to the end portion 6*c* to push it into the other holding slot 8. Although such operation is easier than a conventional operation of mounting the lever on the connector housing while locking the torsion coil spring 6 on both of the lever and the connector housing, the former operation still requires skillful work and results in inefficiency.

In FIGS. 15 and 16, a reference number 10 is a tool aperture through which the tool pin 9 passes so that it pushes the other end portion 6*c* of the spring 6 in the other holding slot 8 toward the projection 1*a* on the connector housing 1.

SUMMARY OF THE INVENTION

An object of the present invention is to provide a lever type connector assembly in which a process of attaching a torsion coil spring to a lever beforehand can be simplified and an entire assembling work of connectors can be greatly improved.

In order to achieve the above object, a lever type connector assembly in accordance with the present invention comprises: a pair of first and second connector housing; a lever having a pair of arms on opposite ends and mounted rotatably on said first connector housing, said arm being provided on its inner face with a cam groove which engages with a cam follower on said second connector housing, said first and second connector housings being connected with and detached from each other when said lever is turned to move said cam follower; torsion coil springs having a central ring portion and a pair of first and second end portions extending from said ring portion, each torsion coil spring being coupled to said first connector housing and said arm of said lever to bias said lever toward a given rotary direction, said arm of said 1ever being provided on its inner face with a central ring slot adapted to accommodate said ring portion of said central ring portion and a pair of first and second holding slots communicated with said central ring slot and adapted to accommodate said first and second end portions of said spring with said spring being biased; means for transferring said second end portion of said spring accommodated in said second holding slot in said arm to said first connector housing after mounting said lever to said first connector housing; and means provided on said inner faces of said arms for assuring engagement with a tool and said second end portion of said spring when transferring said one end portion to said first connector housing.

Said assuring means may be an raised guide which is formed near an outer edge of said holding slot and which has a ramp face which continuously increases a height with approaching to said second holding slot and a precipice contiguous to said outer edge of said second holding slot.

Further, said assuring means may be a tool slot extending from an end face of said arm across said cam groove to said second holding slot.

The torsion coil spring is mounted on the arm of the lever by the following processes. In the case of providing the raised guide on the arm, the first end portion of the torsion coil spring is inserted into the first holding slot and the second end portion of the spring is moved toward the second holding slot while biasing the spring. When the second end portion approaches the second holding slot, it rides on the ramp face of the raised guide to generate a downward elastic force. When the second end portion rides over the ramp face and reaches the precipice, it falls down into the second holding slot by its downward elastic force.

After attaching the torsion coil spring to the lever, the lever is mounted on the first connector housing and the second end portion is pushed out of the second holding slot. The second end portion pushed out of the slot engages with the first connector housing so that the lever is biased toward the given rotary direction.

On the other hand, in the case of providing the tool slot in the arm, the tool pin is inserted into the tool slot from the end face of the arm and the tool pin is moved in the tool slot toward the second holding slot. At this time, the tool pin pushes the second end portion of the torsion coil spring against its elastic force toward the second holding slot. When the second end portion reaches the outer edge of the second holding slot, the tool pin is turned down so that the second end portion is inserted into the second holding slot.

As described above, according to the lever type connector assembly in which the raised guide is provided on the arm of the lever, since after the torsion coil spring is predeterminedly attached to the lever, the lever can be mounted on the first connector housing without handling the spring, the work of mounting the lever on the first connector housing can be greatly facilitated. Further, since the ramp face of the raised guide causes the second end portion of the spring to be inserted into the second holding slot by the downward elastic force, the work of attaching the torsion coil spring to the lever can be greatly enhanced and the entire work of constructing the connector assembly can be greatly improved.

According to the lever type connector housing assembly in which the tool slot is provided in the arm of the lever, the tool pin is inserted into the tool slot so that an intermediate portion of the tool pin can push the second end portion of the torsion coil spring to the second holding slot without leaping the second end portion over the tool pin.

BRIEF DESCRIPTION OF THE DRAWINGS

FIG. 4 is an enlarged longitudinal sectional view of a raised guide;

DETAILED DESCRIPTION OF THE PREFERRED EMBODIMENTS

Figure 1:
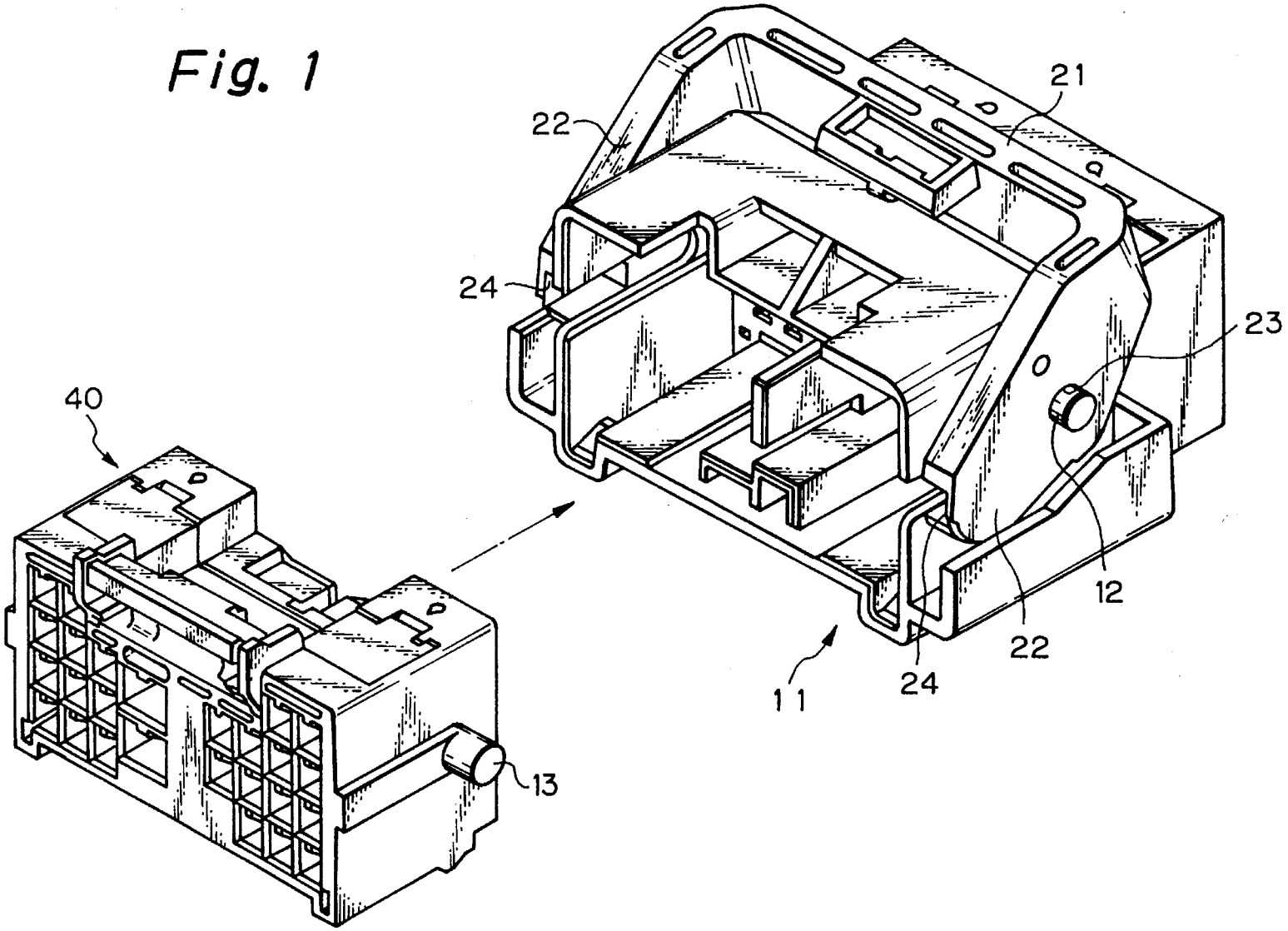
FIG. 1 is an exploded perspective view of a lever type connector assembly, illustrating a position in which a female connector housing is separated from a male connector housing on which a lever is mounted.
Figure 2:
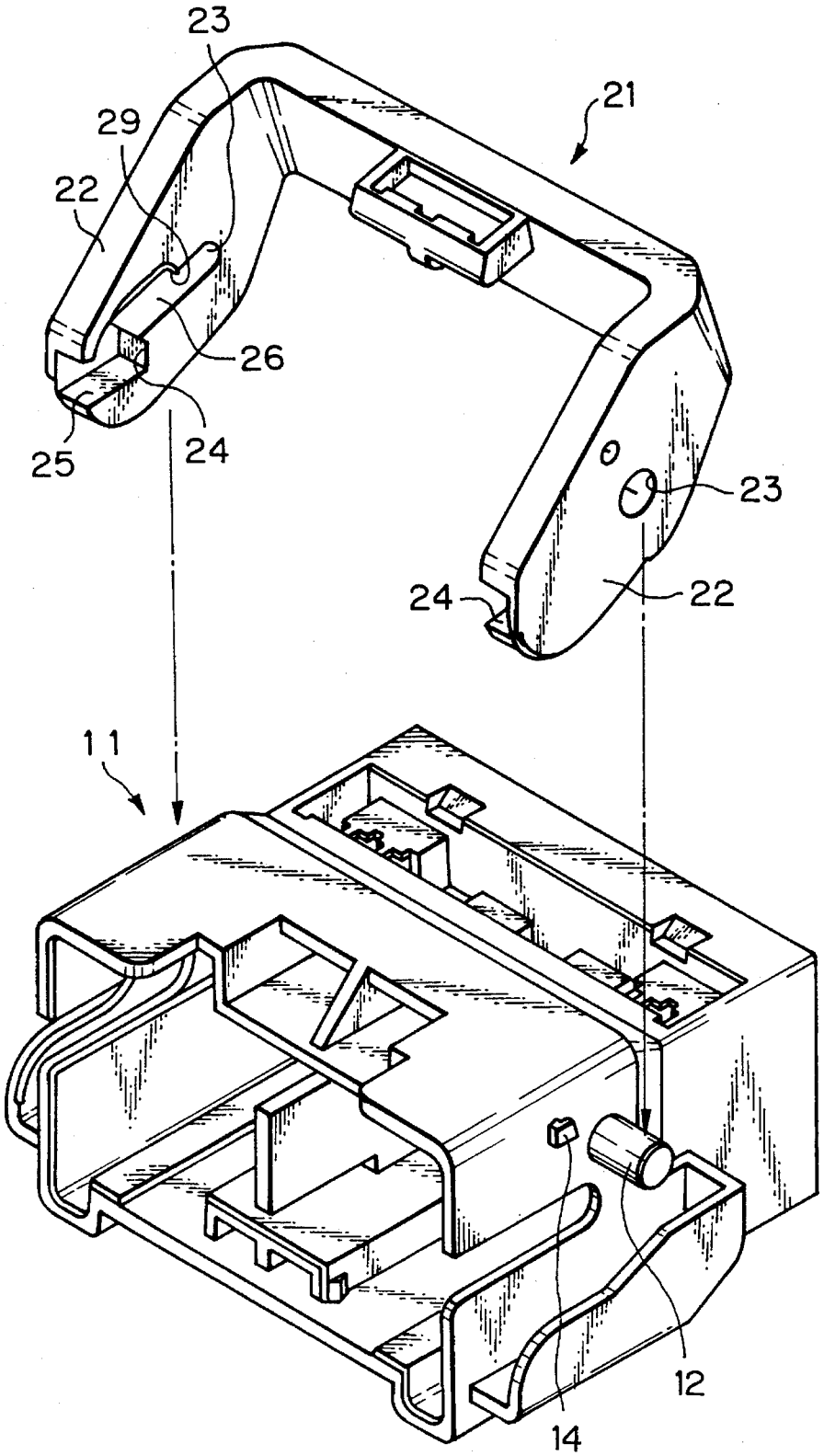
FIG. 2 is a perspective view of the male connector housing, illustrating a position in which the lever is detached from the male connector housing.

Embodiments of a lever type connector assembly in accordance with the present invention will be explained below by referring now to the drawings.

FIGS. 1 through 6 show a first embodiment of the lever type connector assembly of the present invention.

A male (first) connector housing 11 is open at a front side end. A plurality of male terminals not shown are disposed in the interior of the housing 11 with the terminals extending toward the front side end. The male connector housing 11 is provided on its opposite sides with support axles 12 disposed coaxially for bearing a lever 21 described hereinafter.

On the other hand, a female (second) connector housing 40 has a shape and a size suitable for being received in a front opening in the male connector housing 11. A plurality of female terminals not shown are disposed in the interior of the female connector housing with the terminals extending toward a front side end. When the male and female connector housings 11 and 40 are completely interconnected, the male and female terminals are electrically connected. The female connector housing 40 is provided on opposite sides with cam followers 13, 13 which cooperate with the lever 21 to interconnect the housings 11 and 40.

The lever 21 is provided on opposite ends with side plates or arms 22, 22 extending in parallel with each other and generally formed into a U-shaped block. The arms 22 and 22 of the lever 21 are provided with bearing holes 23 and 23 which are disposed coaxially. The lever 21 is mounted on the male connector housing 11 by inserting the support axles 12, 12 into the bearing holes 23, 23. The arms 22, 22 are provided on inner faces with cam grooves 24, 24 which extend from one end faces to inner parts of the arms. A width of the cam groove 24 is equal to or larger than a diameter of the bearing hole 23.

Upon coupling the female connector housing 40 to the male connector housing 11, the lever 21 is mounted on the male connector housing 11, the housings 11 and 40 are opposed to each other at their front sides and approached to each other, the cam follower 13 on the female connector housing 40 is fitted in an end of the cam groove 24 in the lever 21, the lever 21 is turned about the support axle 12 to pull the cam follower 13 into the cam groove 24, the lever 21 is further turned to forcibly approach the connector housings 11 and 40 to each other by a "lever action", and the connector housings 11 and 40 are finally interconnected.

Figure 14:
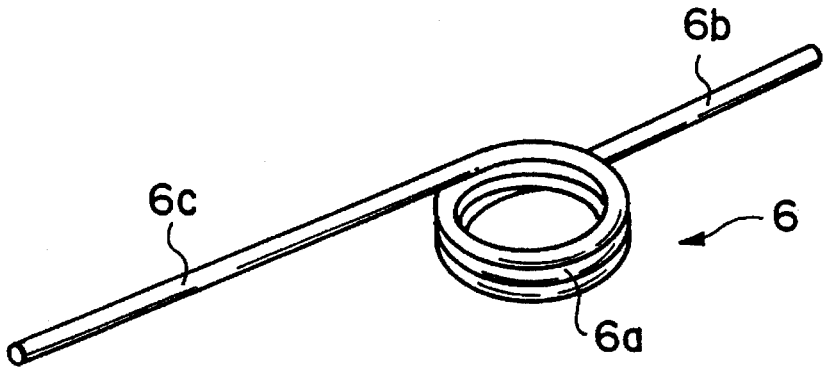
Fig. 14 PRIOR ART
FIG. 14 is a perspective view of a conventional torsion coil spring.
Figure 15:
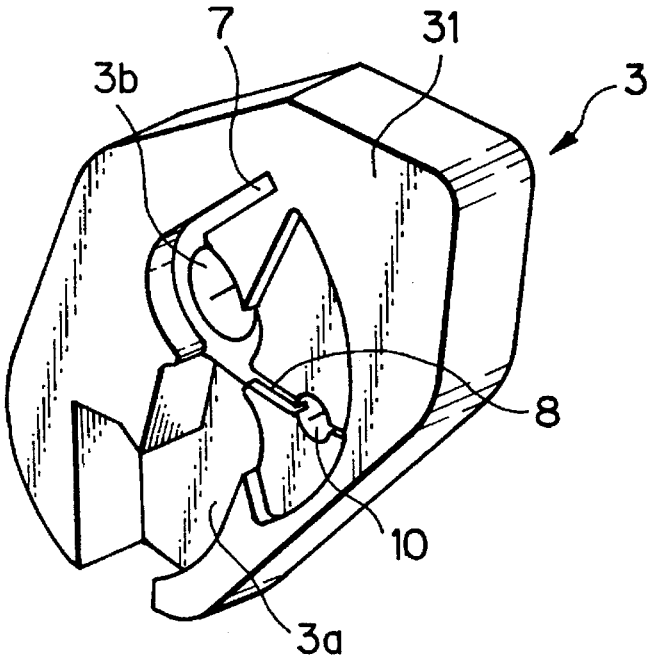
Fig. 15 PRIOR ART
FIG. 15 is a fragmentary enlarged perspective vie of the lever shown in FIG. 11.
Figure 16:
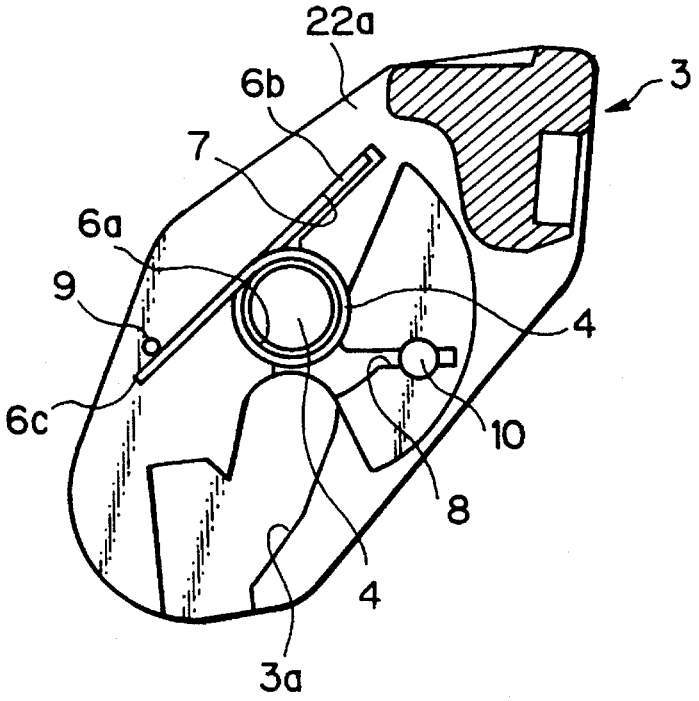
Fig. 16 PRIOR ART
FIG. 16 is a cross sectional view of the lever shown in FIG. 11, illustrating a process of attaching the torsion coil spring to the lever.
Figure 17:
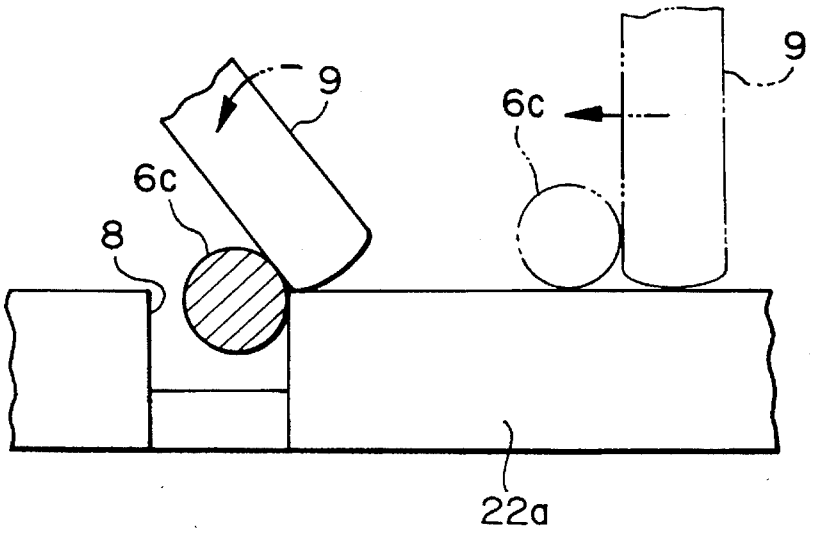
Fig. 17 PRIOR ART
FIG. 17 is a longitudinal sectional view of the lever, illustrating a process of attaching an end of the torsion coil spring into a holding slot in the lever.

A torsion coil spring 6 is disposed between the lever 21 and an engaging projection 14 (see FIG. 2) in order to bias the lever 21 in a given rotary direction relative to the male connector housing 11. The torsion coil spring 6 is a common shape shown in FIG. 14 and has a ring portion **6*a* formed by winding a spring wire into a coil and a pair of first and second end portions 6*b* and 6*c* extending tangentially from the ring portion 6*a*. The legs 6*b* and 6*c* extend straightly by an angle of 180° therebetween as shown in FIG. 14 when no external force is applied to the spring 6**.

Figure 3:
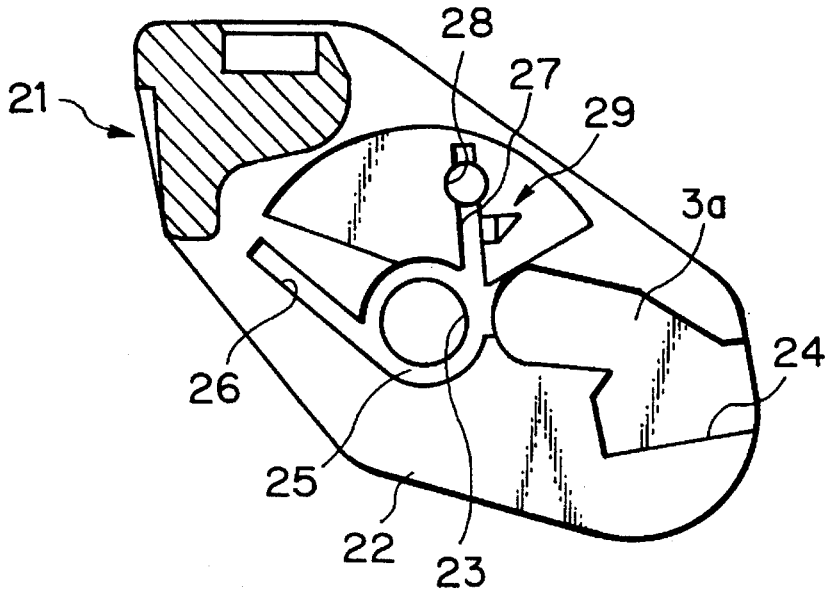
Figure 4:
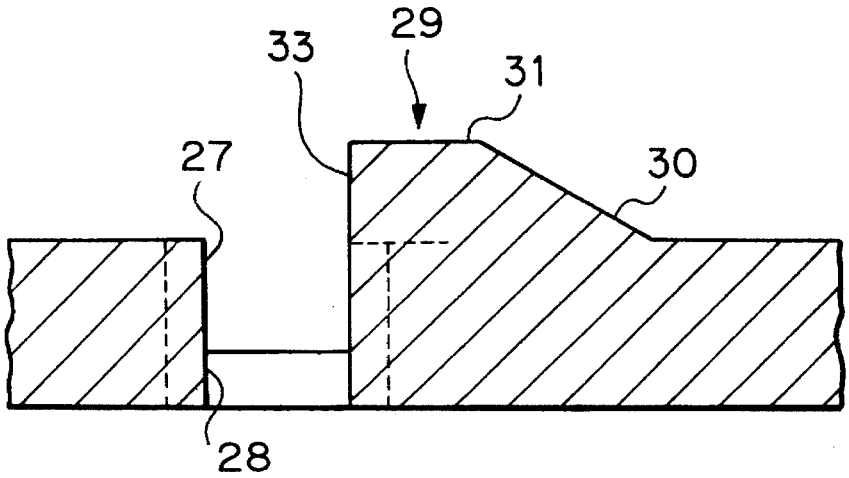
FIG. 4 is a cross sectional view of a lever in a first embodiment of a lever type connector assembly in accordance with the present invention.

In order to mount the torsion coil spring 6 on the lever 21, the arm 22 of the lever 21 is provided in its inner face with a ring slot 25 around the bearing hole 23 for accommodating the ring portion **6*a* and a pair of first and second holding slots 26 and 27 communicated with the ring slot 25 for accommodating the portions 6*b* and 6*c*, as shown in FIG. 3. An angular distance between the holding slots 26 and 27** is set to be, for example, 60° or so. The portions 6*b* and **6*c* are received in the holding slots 26 and 27 by approaching the portions 6*b* and 6*c* with each other against the elastic force of the torsion coil spring 6. An aperture 28 is formed in a middle portion of the (second) holding slots 27 in the arm 22 of the lever 21. The aperture 28 permits a tool pin not shown to eject the second end portion 6*c* from the second holding slot 27** by inserting the tool pin into the aperture.

Figure 5A:
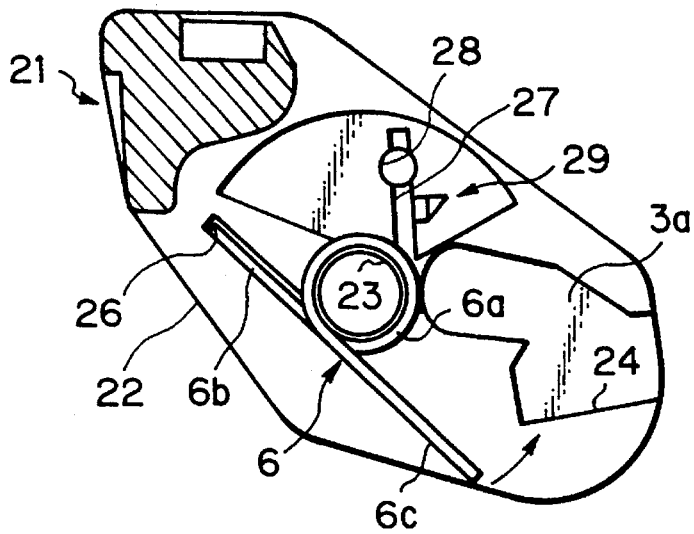
FIGS. 5A to 5C a cross sectional views of the lever in the first embodiment, illustrating processes of attaching a torsion coil spring to the lever.
Figure 5B:
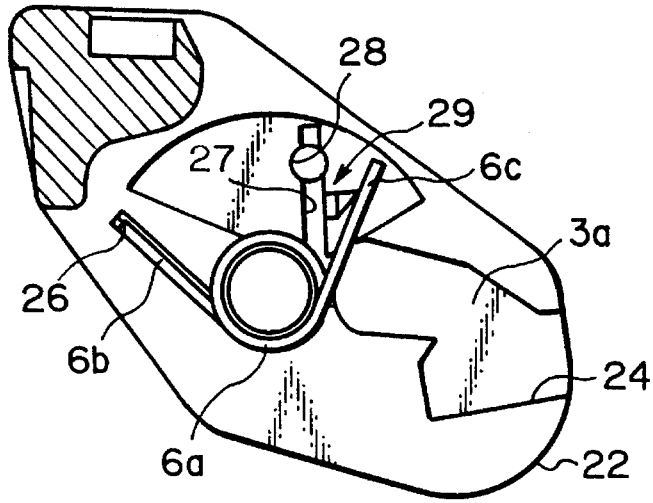
Figure 5C:
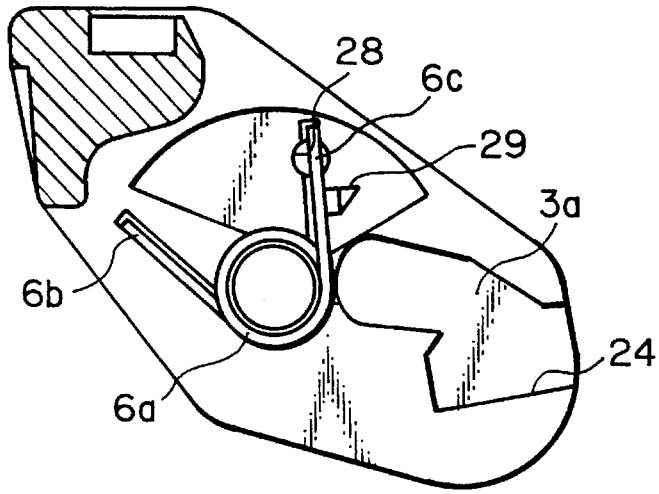
Figure 6:
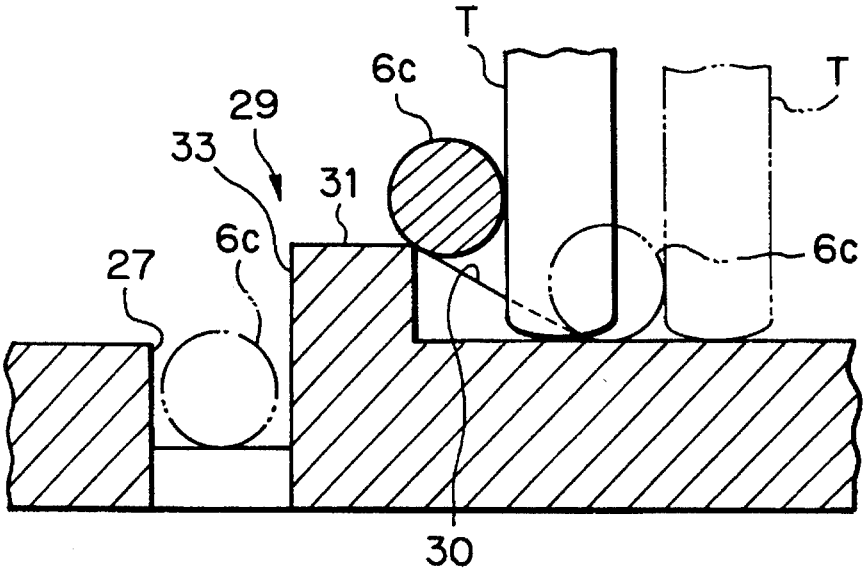
FIG. 6 is a sectional view similar to FIG. 4, illustrating a process of attaching an end of the torsion coil spring into a holding slot in the lever.

As shown in FIGS. 4 and 5A to 5C, the arm 22 is provided near an outer edge of the first holding slot 27 having the aperture 28 in the inner face with a raised guide 29. The raised guide, as shown in FIGS. 5A to 5C, has a ramp face 30 which continuously increases a height with approaching to the second holding slot 27, a flat top 31 and precipice 33 contiguous to the outer edge of the second holding slot 27.

Next, a process of constructing the first embodiment of the lever type connector assembly will be explained below.

Before the lever 21 is mounted on the female connector housing 11, the torsion coil spring 6 is mounted on the lever 21. The first end portion **6*b* of the spring 6 is received in the first holding slot 26 and the central ring portion 6*a* is received in the ring slot 25. The spring 6 is free of load, so that an angle between the end portions 6*b* and 6*c* is about 180°. Accordingly, the second end portion 6*c* is spaced from the second holding slot 27, as shown in FIG. 5A. Then, an elongated tool pin T engages with the second end portion 6*c* and pushes It against its elastic force to slide it on the inner face of the lever 21 toward the second holding slot 27 in a direction shown by an arrow in FIG. 5**A.

As shown in FIG. 5B, when the second end portion **6*c* of the torsion coil spring 6 reaches near the second holding slot 27, the portion 6*c* encounters the raised guide 29 and receives an upward reaction force by the ramp face 30. Consequently, the second end portion 6*c* moves on the ramp face 30 while the portion slides upwardly on the tool pin T (see FIG. 6). When the second end portion 6*c* reaches the flat top 31 of the raised guide 29, an upward elastical deformation of the second end portion 6*c* becomes maximum. When the portion 6*c* reaches the precipice 33 through the flat top 81, the portion 6*c* falls into the second holding slot 27 by its elastical force as shown by a two-dot-chain line in FIG. 6. In the first embodiment, the second end portion 6*c* of the torsion coil spring 6 is naturally accommodated in the second holding slot 27 only by pushing the portion 6*c* toward the slot 27 by the tool pin T. Accordingly, it is possible to readily accommodate the portion 6*c* in the slot 27 without pushing it into the slot 27** in the conventional assembly.

After the torsion coil spring 6 is mounted on the lever 21, the support axles 12 of the male connector housing 11 are fitted in the bearing holes 23 in the lever 21, so that the lever 21 is mounted on the connector housing 11. At this time, since the lever 21 can be mounted on the connector housing 11 in spite of existence of the spring 6, such mounting operation can be simplified. When the tool pin is inserted into the aperture 28 in the lever 21 to push the second end portion **6*c* of the spring 6, the second end portion 6*c* is ejected from the second holding slot 27 and engages with the engaging projection 14 on the male connector housing 11. Consequently, since the first end portion 6*b* of the spring 6 is still received in the first holding slot 26 while the second end portion 6*c* engages with the projections on the male connector housing 11, the lever 21 is biased toward the given rotary direction by the elastic force of the spring 6**.

According to the first embodiment, since the lever 21 on which the torsion coil spring 6 is mounted beforehand can be mounted on the connector housing 11, the mounting operation of the lever can be greatly simplified and, in addition, the torsion coil spring 6 can be readily attached to the lever 21 by displacing the second end portion **6*c*** in a direction by means of the tool pin. Generally, the constructing operation of the connector assembly can be considerably improved.

It should be noted that the present invention is not limited to the first embodiment but can be altered by, for example, the following forms:

(a) Although the bearing hole 23 passes through the arm 22 in the embodiment, the hole may be formed into a blind hole which is open not in the outer face but in the inner face; or (b) Although the lever 21 is mounted on the male connector housing 11 in the embodiment, the lever may be mounted on the female connector housing and the cam follower may be provided on the male connector housing.

Figure 7:
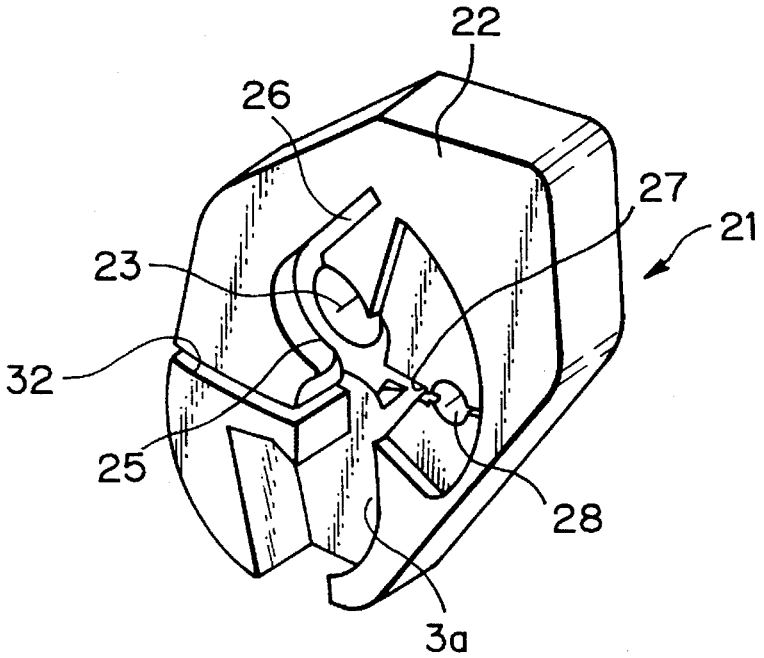
FIG. 7 is a perspective view of a side plate of a lever in a second embodiment of the lever type connector assembly in accordance with the present invention.

Next, a second embodiment of the lever type connector assembly in accordance with the present invention will be explained below by referring to FIGS. 7 to 9.

In the second embodiment, a side plate or arm 22 of the lever 21 is provided in its inner face with a tool slot 32 extending from an end face across the cam groove 3*a* to the second holding slot 27. The tool slot 32 is formed into a circular arc and has the same depth as that of the cam groove 3*a*.

Figure 8A:
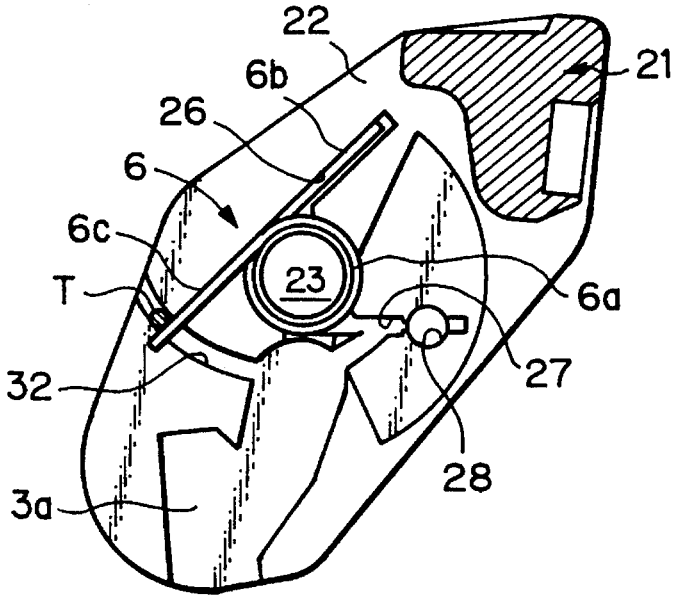
FIGS. 8A to 8C are cross sectional views of the lever in the second embodiment, illustrating processes of attaching the torsion coil spring to the lever.
Figure 8B:
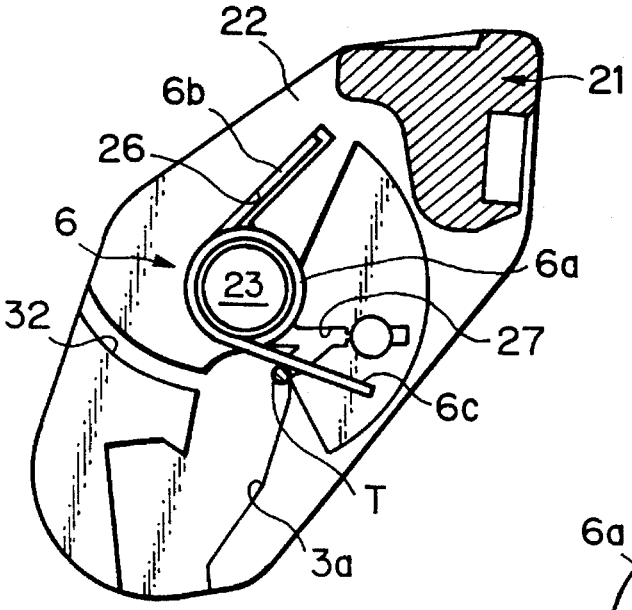
Figure 8C:
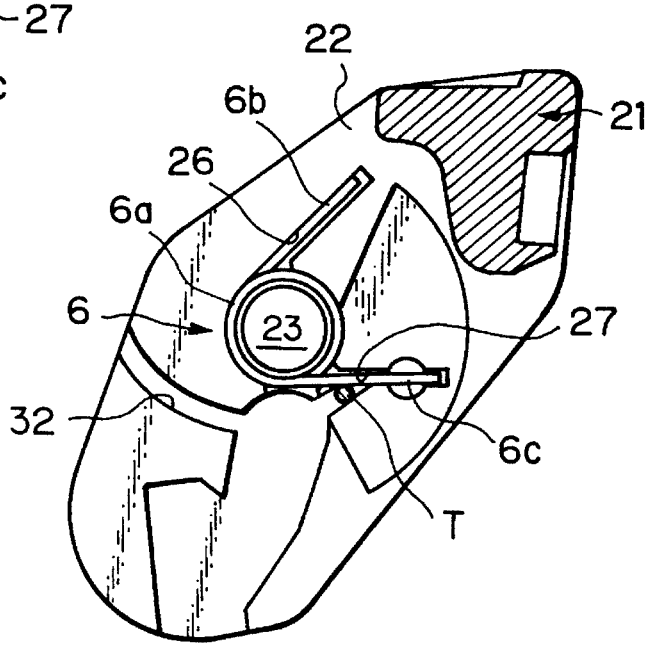

In the case of attaching the torsion coil spring 6 to the arm 22 temporarily, the coil portion 6*a* of the spring 6 under no load is received in the ring slot 25 around the hole 23, the first end portion 6*b* of the spring 6 is received in the first holding slot 26, and the second end portion 6*c* of the sprig 6 rests on the inner face of the arm 22 across the tool slot 32, as shown in FIG. 8A.

The tool pin T is inserted into the tool slot 32 so that it can push the second end portion 6*c* toward the second holding slot 27.

Then, the tool pin T is moved in the tool slot 32 across the cam groove 3*a* (see FIG. 8B) to a position near the second holding slot 27 while displacing the second end portion 6*c* against its elastic force to a position immediately above the second holding slot 27. Finally, the tool pin T is inclined to the second holding slot 27 to push the second end portion 6*c* into the second holding slot 27.

Figure 9:
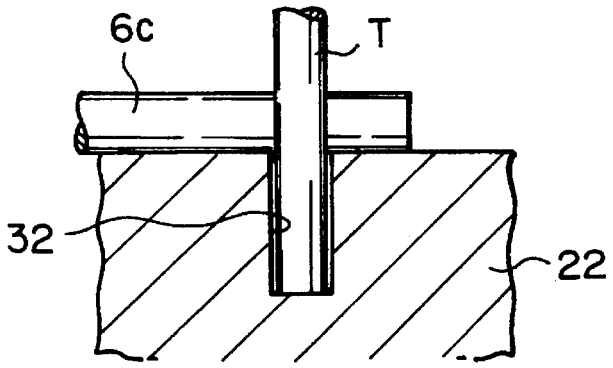
FIG. 9 is a fragmentary cross sectional view of the lever, illustrating a process of attaching an end of the torsion coil spring into a holding slot in the lever.
Figure 10:
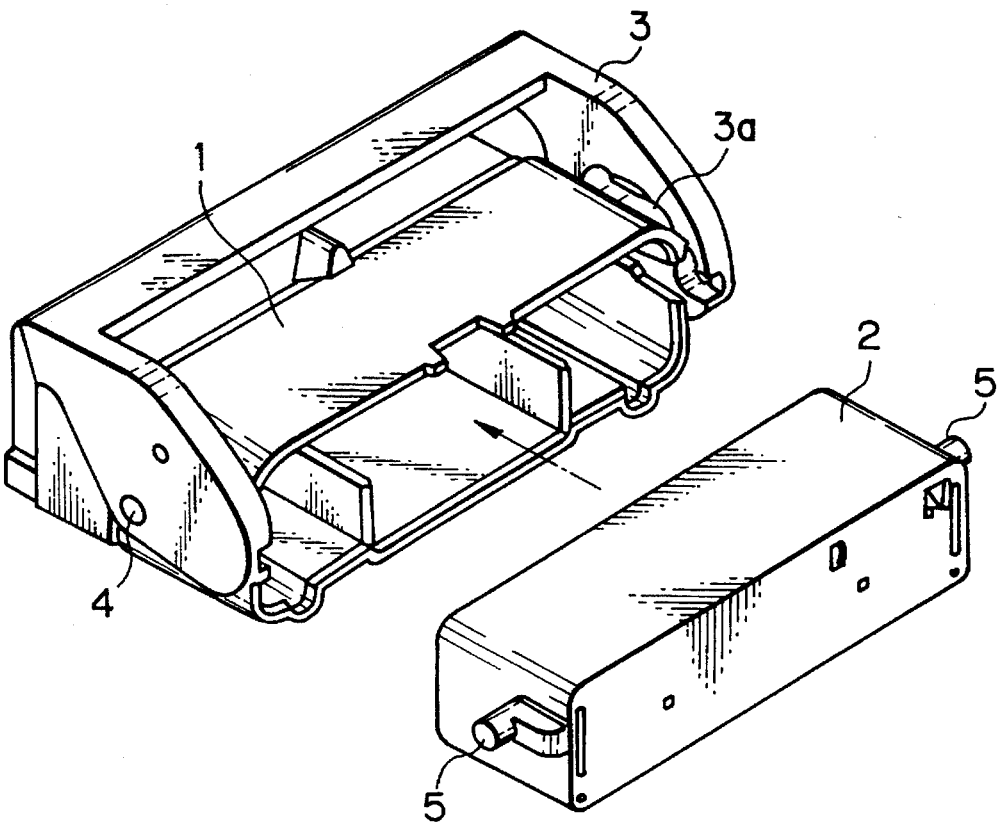
Fig. 10 PRIOR ART
FIG. 10 is an exploded perspective view of a conventional lever type connector assembly.
Figure 11:
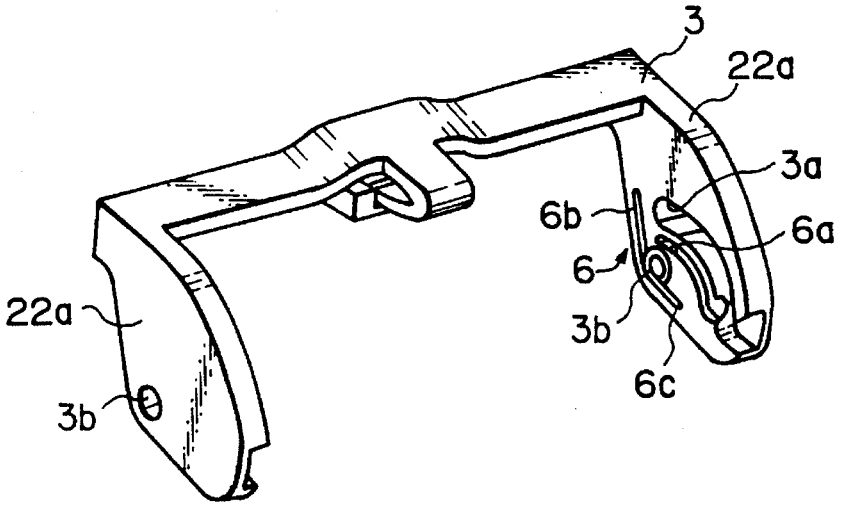
Fig. 11 PRIOR ART
FIG. 11 is a perspective view of a lever shown in FIG. 10, illustrating a torsion coil spring mounted on a side plate of the lever.
Figure 12:
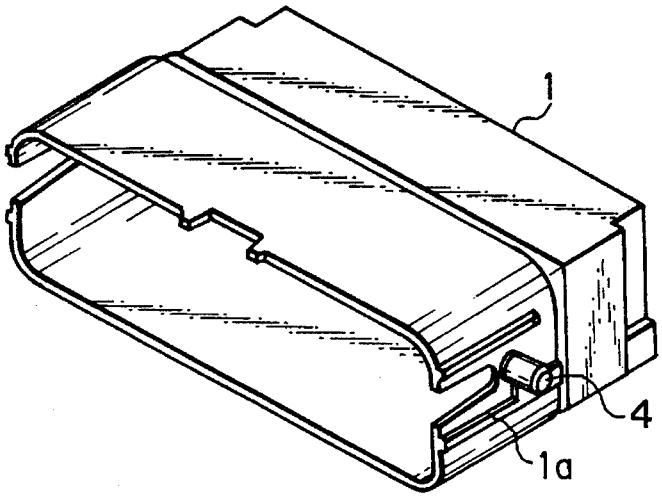
Fig. 12 PRIOR ART
FIG. 12 is a perspective view of a female connector housing shown in FIG. 10.
Figure 13:
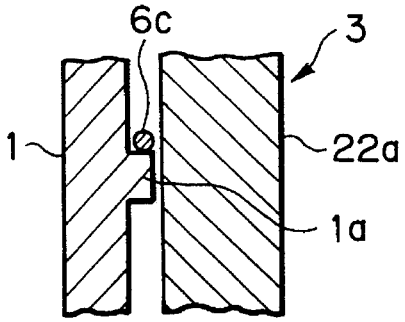
Fig. 13 PRIOR ART
FIG. 13 is a fragmentary cross sectional view of the housing and lever shown in FIG. 10, illustrating a position at which an end of the torsion coil spring engages with the housing.

Since the distal end of the tool pin T is inserted into the tool slot 32 as shown in FIG. 9 during displacement of the second end portion 6*c*, that is, a middle portion of the tool pin pushes the second end portion 6*c*, it does not leap over the tool pin on the way to the second holding slot 27.

In the case of pushing the second end portion 6*c* of the spring 6 by the end of the tool pin T, the portion 6*c* tends to leap over the tool pin T at a position, at which an elastic force of the spring 8 is very enhanced, near the second holding slot 27, Accordingly, the tool slot 82 may be provided on only an area between the cam groove 3*a* and the second holding slot 27, the tool pin T may slide on the inner face of the arm 22 at the beginning of pushing the second end portion 6*c*, the tool pin will fall down into the cam groove 3*a* and move in the tool slot 82 communicated with the second holding slot 27 to push the portion 6*c* into the slot 27. This can prevent the second end portion 6*c* from leaping over the tool pin T.

What is claimed is:

1. A lever type connector assembly comprises:

a pair of first and second connector housings;

a lever having a pair of arms on opposite ends and mounted rotatably on said first connector housing, said arms being provided on its inner face with a cam groove which engages with a cam follower on said second connector housing, said first and second connector housings being connected with and detached from each other when said lever is turned to move said cam follower;

torsion coil springs having a central ring portion and a pair of first and second end portions extending from said ring portion, each torsion coil spring being coupled to said first connector housing and said arm of said lever to bias said lever toward a given rotary direction, said arm of said lever being provided on its inner face with a central ring slot adapted to accommodate said ring portion of said central ring portion and a pair of first and second holding slots communication with said central ring slot and adapted to accommodate said first and second end portions of said spring with said spring being biased;

means for transferring said second end portion of said spring accommodated in said second holding slot in said arm to said first connector housing after mounting said lever to said first connector housing; and means provided on said inner faces of said arms for assuring engagement with a tool and said second end portion of said spring when transferring said second end portion to said first connector housing.

2. A lever type connector assembly according to claim 1, wherein said assuring means is an raised guide which is formed near an outer edge of said second holding slot and which has a ramp face which continuously increases in height approaching said second holding slot and a precipice contiguous to said outer edge of said second holding slot.

3. A lever type connector assembly according to claim 1, wherein said assuring means in a tool slot extending from an end face of said arm across said cam groove to said second holding slot.

* * * * *